United States Patent [19]

Zigenfus

[11] Patent Number: 4,801,921

[45] Date of Patent: Jan. 31, 1989

[54] ABDOMINAL MUSCLE FIRMNESS ALARM

[76] Inventor: Robert W. Zigenfus, 8122 Larch La., Evansville, Ind. 47710

[21] Appl. No.: 88,252

[22] Filed: Aug. 24, 1987

[51] Int. Cl.[4] ..... G08B 21/00

[52] U.S. Cl. ..... 340/573; 272/93; 340/309.15; 340/407; 368/109

[58] Field of Search ..... 340/573, 309.15, 407; 272/93; 128/25 R; 368/12, 109, 243, 327

[56] References Cited

U.S. PATENT DOCUMENTS

| | | | |
|---|---|---|---|
| 3,614,763 | 10/1971 | Yannuzzi | 340/573 |
| 3,670,320 | 6/1972 | Palmer | 340/573 |
| 3,929,335 | 12/1975 | Malick | 128/25 R |
| 3,973,251 | 8/1976 | Stephas | 340/309.15 |
| 3,998,209 | 12/1976 | Macvaugh | 340/407 |
| 4,007,733 | 2/1977 | Celeste et al. | 340/573 |
| 4,191,949 | 3/1980 | Myers | 340/573 |
| 4,237,449 | 12/1980 | Zibell | 340/407 |
| 4,396,904 | 8/1983 | Hanaoka | 340/309.15 |

*Primary Examiner*—Glen R. Swann, III

*Attorney, Agent, or Firm*—Warren D. Flackbert

[57] ABSTRACT

An abdominal muscle firmness alarm is characterized by a control unit containing a mechanism for producing a signal in the form of an electrical charge or a vibration impulse; a switch for controlling operation; a timer for selecting the interval between the transmitted signals; and, discs interconnecting the control unit and selectively affixed to the wearer's abdominal region over the Rectus muscles. When the wearer senses the signal through the aforesaid discs, the wearer is reminded to contract the muscles of the abdomen, increasing the muscle tone of the latter and serving restoring and abdomen flattening purposes.

6 Claims, 1 Drawing Sheet

ABDOMINAL MUSCLE FIRMNESS ALARM

BACKGROUND OF THE INVENTION

As is known, muscle fitness, either on an individual basis or through organized programs, is of increasing importance and interest. One physical region of concern to almost everyone is a protruding abdomen. The latter is generally a result of either excess weight or the loss of muscle tone in the abdominal wall, or both. In the former, excess weight results in the body storing fat or adipose tissue over the muscular wall of the abdomen.

While excess weight can be controlled or at least remedied, to some degree, by dietary habits, the loss of "postural tone," i.e. muscle tone in the abdominal muscles, can only be reversed, in part, by exercises, such as bent-knee sit-ups, but, as to the latter, it is oftentimes difficult to consciously maintain a desired toning schedule during routine daily activities.

SUMMARY

The invention, in the form of an abdominal muscle firmness alarm, presents an inexpensive device that periodically signals and/or reminds the wearer to contract the muscles of the abdomen. In this connection, and by way of example, a one second signal can be provided for each minute, where the wearer progressively increases the time between signals as need dictates. As a result of the preceding, over a given time period and depending upon the individual, muscle tone of the abdomen will be restored and abdomen flattening result.

More specifically, the preceding is accomplished through the use of discs disposed on the abdomen, laterally of the umbilicus and over the Rectus muscles, where, at preselected intervals, the aforesaid signals are caused to pass through the discs and, thereafter, repeat in response to timer control. In other words, the signals remind the wearer to contract the abdominal muscles.

In any event, a better understanding of the present invention will become more apparent from the following description, taken in conjunction with the accompanying drawing, wherein

DESCRIPTION OF THE PREFERRED EMBODIMENT

Figure 1:
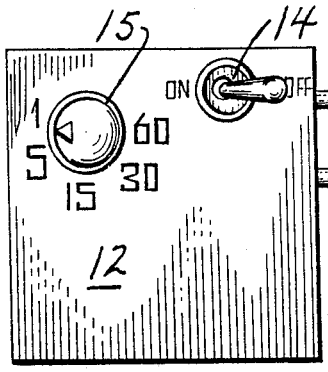
Fig. 1 is a front plan view of an abdominal muscle fitness alarm in accordance with the teachings of the present invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
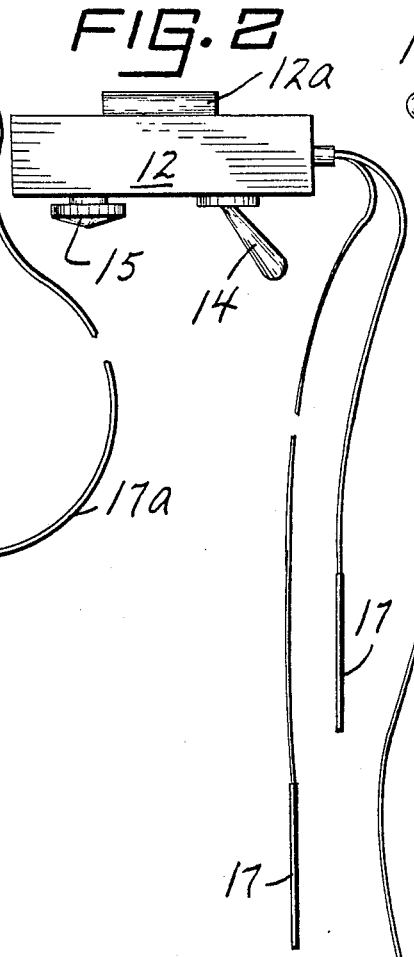
FIG. 2 is a top plan view of the invention, looking downwardly on FIG. 1.
Figure 3:
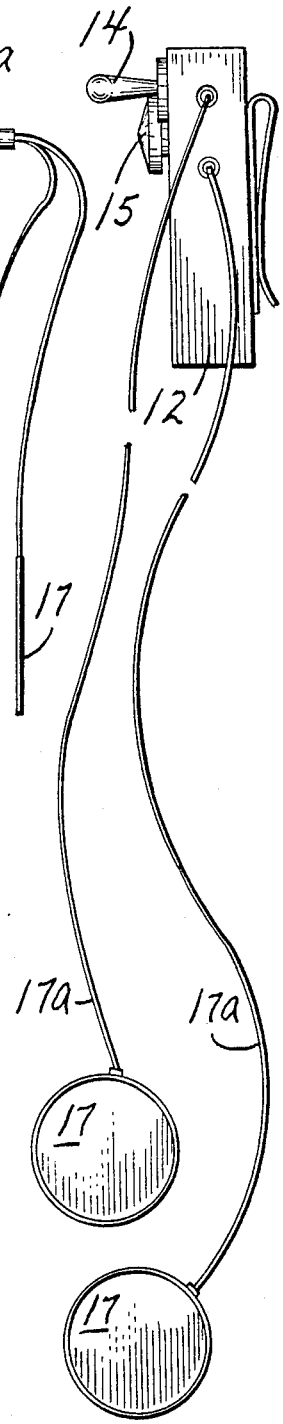
FIG. 3 is a view in side elevation, looking from right to left in FIG. 1, further detailing the instant alarm; and, Fig. 4 is a view in front elevation showing typical usage of the alarm of the invention on an individual.

Referring now to the figures, and particularly FIGS. 1, 2 and 3, the abdominal muscle firmness alarm presented by the invention includes a control unit 12 with an associated on-off toggle switch 14 and a common battery operated variable timer 15, wherein the latter can be manually set at, for example, one minute, five minutes, fifteen minutes, thirty minutes and sixty minutes. The control unit 12 includes a clip **12*a*** on its rear surface for ready positioning on a user's belt.

Figure 4:
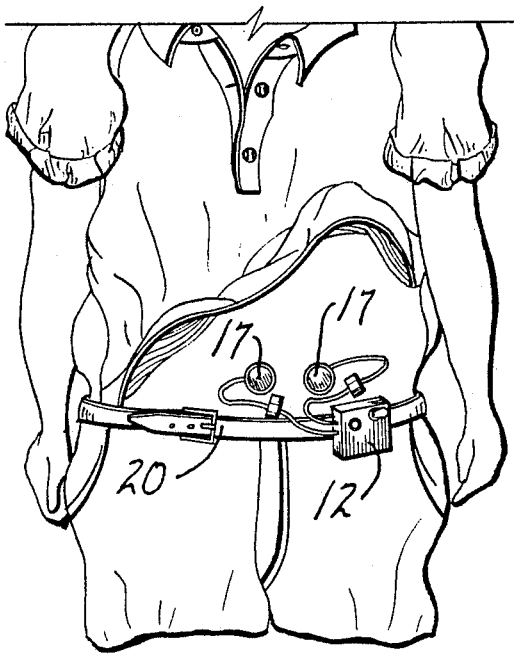

Discs 17, typically made from a soft pliable rubber-like material, are disposed at the ends of flexible wires **17*a* extending from the control unit 12. The inner mechanism (not detailed) of the control unit 12 includes battery operated electric or electro-mechanical arrangements for transmitting a signal, as, for example, a low voltage electrical charge or a vibration impulse through the wires 17*a* to the discs 17. In use, and as evident in FIG. 4, discs 17** are placed on the abdomen of the user, laterally of the umbilicus and preferably over the Rectus muscles, adhesively or by taping, for example.

Again referring to FIG. 4, the control unit 12 is disposed, by reason of clip **12*a* into a use position on an individual's belt 20, where the discs 17 are then positioned on the wearer's abdominal region. The control unit 12 is energized, as by means of the switch 14, and the timer 15** set for any desired time interval.

As stated, a signal, such as a vibration impulse or an electrical charge, lasting one second, repeats at the preselected time interval. Thus, and by way of example, the wearer can start with a one second reminder signal every minute, and then progressively increase the time of the signal as the individual usage demands. When the signal is received, the wearer is reminded to contract the abdominal muscles. In any event, over a period of time, depending on the individual's condition, the muscle tone of the abdomen is restored and returned to a flattened condition.

From the preceding, it should be evident that the instant abdominal muscle firmness alarm serves effective usage purposes in a simple and yet direct manner. The control unit is compact and the impulse or charge transmitting discs are easily positioned for use. The timer presents an adequate selection of time intervals between the signals, i.e. the charges and/or impulses.

The abdominal muscle firmness alarm is susceptible to various changes within the spirit of the invention as, for example, in proportioning; the particular arrangement utilized for providing the desired signal; the configuration of the wearer carried discs; the manner of positioning the control unit on the wearer's person; and, the like. Thus, the preceding should be considered illustrative and not as limiting the scope of the following claims:

I claim:

1. An abdominal muscle firmness trainer comprising a control unit, a signalling member selectively affixed to the abdominal region of a wearer, and means serving to transmit a signal to said signalling member, said control unit including associated timer means programming said signal transmission at a preselected interval.

2. The abdominal muscle firmness trainer of claim 1 further comprising means to selectively mount said control unit on the person of the wearer.

3. The abdominal muscle firmness trainer of claim 1 where said signalling member is a disc.

4. The abdominal muscle firmness trainer of claim 1 where said signal is a vibration impulse.

5. The abdominal muscle firmness trainer of claim 1 where said signal is an electrical charge.

6. The abdominal muscle firmness trainer of claim 1 where said signalling member communicates with said control unit through a flexible wire.

* * * * *